US007559330B1

(12) United States Patent
Christensen, Sr.

(10) Patent No.: US 7,559,330 B1
(45) Date of Patent: Jul. 14, 2009

(54) SYSTEM AND METHOD FOR EXTENDING A USEFUL LIFE OF A SHAVING RAZOR BLADE

(76) Inventor: Ronald Lee Christensen, Sr., 122 N. Westminster St., Iowa City, IA (US) 52245

( * ) Notice: Subject to any disclaimer, the term of this patent is extended or adjusted under 35 U.S.C. 154(b) by 558 days.

(21) Appl. No.: 11/307,791

(22) Filed: Feb. 22, 2006

Related U.S. Application Data

(60) Provisional application No. 60/655,545, filed on Feb. 23, 2005.

(51) Int. Cl.
*A45D 24/00* (2006.01)
*A45D 27/22* (2006.01)
*A45D 27/00* (2006.01)

(52) U.S. Cl. ..... 132/200; 132/289; 132/292

(58) Field of Classification Search ..... 206/208, 206/352, 228, 209, 207, 354, 355, 15.3, 349; 134/162; 132/286, 292, 289, 200, 249; 30/41, 30/34.2; 222/129, 321.1, 321.7
See application file for complete search history.

(56) References Cited

U.S. PATENT DOCUMENTS 3,019,494 A * 2/1962 Horie et al. ..... 206/208
5,007,533 A * 4/1991 Purohit ..... 206/208
6,006,760 A * 12/1999 Benzinger ..... 132/286
6,145,657 A 11/2000 Cox

* cited by examiner

*Primary Examiner*—Robyn Doan
*Assistant Examiner*—Brianne E O'Neill
(74) *Attorney, Agent, or Firm*—Simmons Perrine Moyer Bergman, PLC

(57) ABSTRACT

A system and method for maintaining sharpness of razor blades in multi-razor cartridges, which includes a cup, a removable and re-sealable lid, a predetermined amount of oil and instructions for storing multiple cartridges in a single container, and the cup being sized for traveling so as to permit the handle and the cartridges to be simultaneously stored in the cup for traveling.

20 Claims, 3 Drawing Sheets

SYSTEM AND METHOD FOR EXTENDING A USEFUL LIFE OF A SHAVING RAZOR BLADE

CROSS REFERENCE TO RELATED APPLICATIONS

This application claims the benefit of the filing date of co-pending provisional patent application entitled "Process to improve life and performance of razor blades", having Ser. No. 60/655,545, which was filed on Feb. 23, 2005, by Ronald Lee Christensen, Sr., which provisional patent application is incorporated herein in its entirety by this reference.

FIELD OF THE INVENTION

The present invention generally relates to shaving razors, and more particularly relates to methods, kits and systems for extending a useful life of a multi-blade shaving razor cartridge.

BACKGROUND OF THE INVENTION

In recent years, razor blade manufacturers have attempted to improve the quality of shaves performed by shaving razors by providing multiple parallel and spaced-apart razor blades in one disposable unit. These additional blades are believed to provide a closer shave, but are also believed to be more expensive to produce and, therefore, contribute to increasing the cost of shaving with a razor.

Typically, these multi-blade razor cartridges (either detachable from a re-usable handle or made with a disposable handle) would last a user on the order of a week before they become dull and their performance degrades to the point where they would often be discarded. The blades may become oxidized over time by exposure to air and water; they may become corroded or have mineral build-up, all reducing the effectiveness of the razor's edge.

Typically, the user of such razor blades will rinse, with water, any hair, dirt, soap, shaving cream, skin, or other debris from the razor cartridge after each shave and store the razor blade until the next shave.

During this time, the wet blade dries but also oxidizes and thereby becomes less sharp.

Consequently, there exists a need for improved methods and systems for maintaining sharpness of a razor blade.

SUMMARY OF THE INVENTION

It is an object of the present invention to provide a system and method for maintaining the sharpness of multi-blade razors.

It is a feature of the present invention to utilize a process for storing the razor blade in a lubricant to reduce oxidation of the blade surface.

It is another feature of the present invention to include a kit to simplify the process of maintaining performance of razor blades.

It is an advantage of the present invention to achieve efficient use and storage of razor blades in a convenient manner.

The present invention is an apparatus and method for maintaining sharpness of multi-blade razors, which is designed to satisfy the aforementioned needs, provide the previously stated objects, include the above-listed features, and achieve the already articulated advantages. The present invention is carried out in a non-oxidation manner in a sense that the oxidation that normally occurs while the blade is stored in the open air is greatly reduced.

Accordingly, the present invention is a system and method including a kit and process to maintain sharpness of razor blades.

BRIEF DESCRIPTION OF THE DRAWINGS

The invention may be more fully understood by reading the following description of the preferred embodiments of the invention, in conjunction with the appended drawings wherein.

DETAILED DESCRIPTION OF THE DRAWINGS

Figure 1:
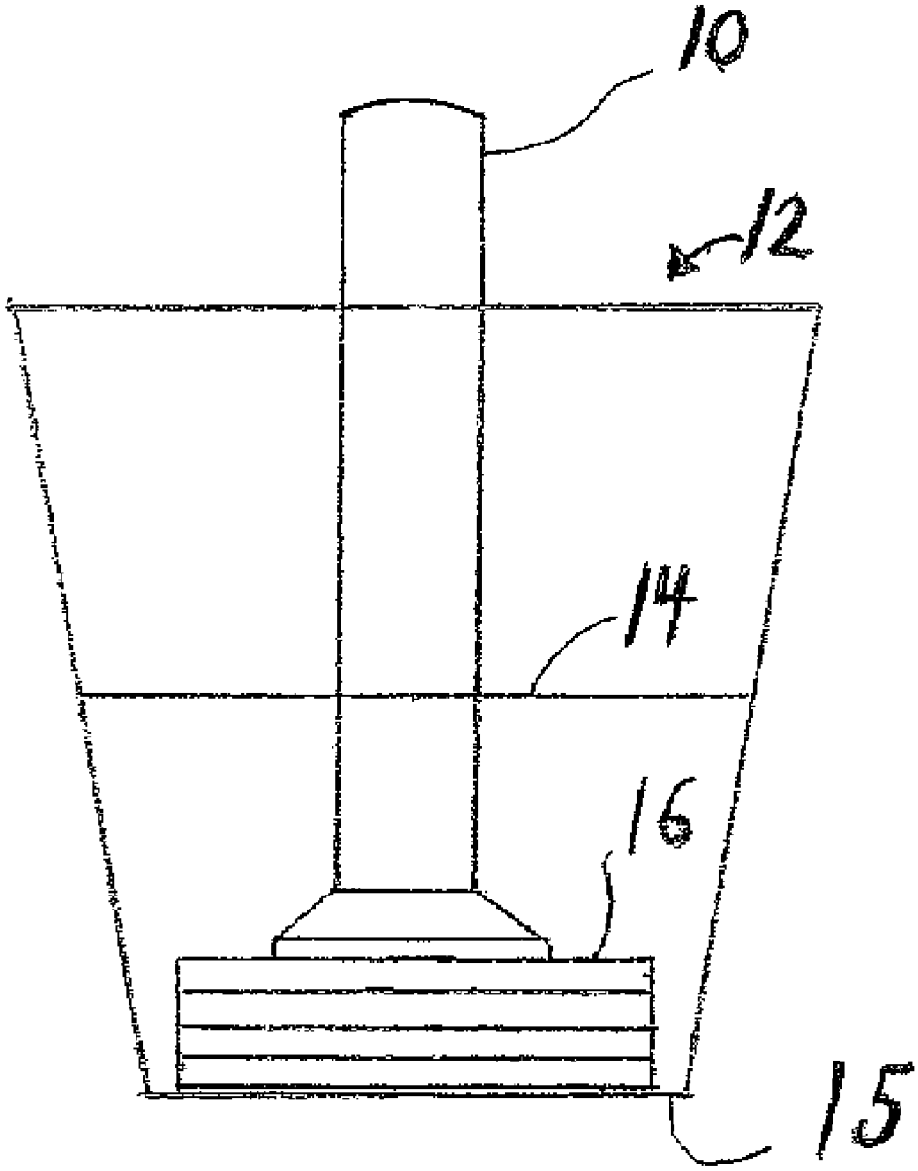
FIG. 1 is a cross-section diagram of a razor sharpness maintaining kit of the present invention, together with a razor and handle disposed therein.

Now referring to the drawings wherein like numerals refer to like matter throughout, and more specifically to FIG. 1, there is shown a cross-sectional view of a kit of the present invention including a razor handle 10, a bottle or cup 12, a razor cartridge 16 coupled to the razor handle 10 and disposed at the bottom 15 of the bottle 12. A top surface of oil 14 is shown disposed in the bottle. Razor handle 10 can be a detachable handle that mates with replaceable cartridges, or it could be a handle that is permanently coupled to the cartridge section of the razor. The term "razor" is used herein to refer to the combination of a handle and a cartridge. The term "cartridge" is used herein to refer to a combination of least two razor blades having parallel and slightly spaced-apart razor edges locked in a shifted and stacked configuration, irrespective if the combination is a detachable component of a multi-part razor or a portion of a disposable razor with an integrated handle and cartridge section.

The cartridge may contain multiple blades. The number of stacked blades in commercially available cartridges has generally increased over time. The oil whose top surface 14 is preferably the surface of a lubricant such as baby oil or mineral oil, is enhanced with fragrance, germicide agents, Vitamin E, aloe vera, etc. The oil in the cup is preferably four (4) ounces, but other amounts which are sufficient to submerge multiple cartridges could be substituted as well. Preferably, the cartridges are covered by between 1 to 1.5 inches of fluid.

The cup 12 is preferably a blow- or injection-molded bottle, but other types of bottles could be used as well.

Figure 2:
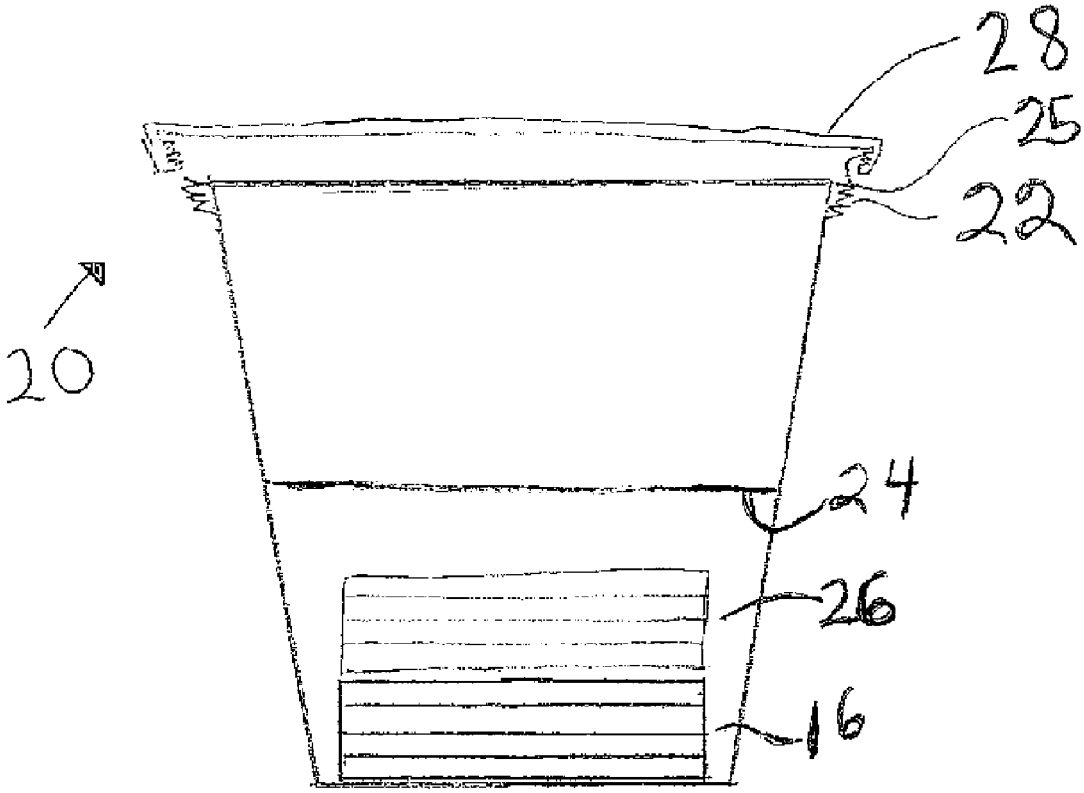
FIG. 2 is a cross-section diagram of a razor sharpness maintaining kit of the present invention, together with two razor cartridges disposed therein.

Now referring to FIG. 2, there is shown a kit of the present invention including a cup 20 having a threaded top 22 and cap 28 with internal threads 25. Cup 20 can be similar to cup 12 of FIG. 1 and could have a means for sealing the oil therein which could be the threaded top 22 and the internal threads 25. Other sealing methods could be used as well, including a flexible pressure fit seal or others. Cup 20 is shown having a first razor cartridge 16 and a second razor cartridge 26 in an oil solution having a top surface 24. The oil in the present invention could be oil other than baby oil and enhanced mineral oil.

Figure 3:
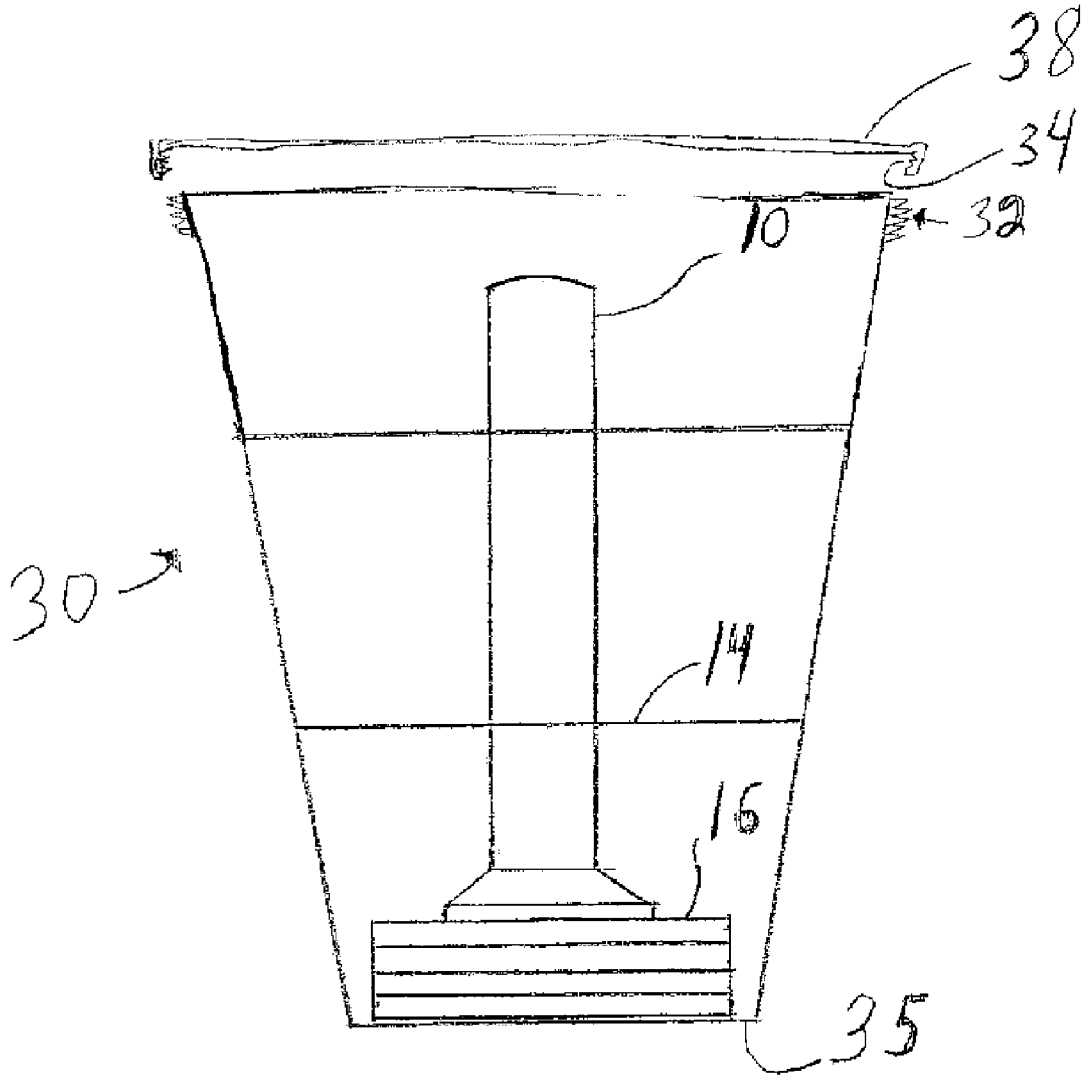
FIG. 3 is a cross-section diagram of a razor sharpness maintaining kit of the present invention with an extended bottle for containing an entire razor and handle therein.

Now referring to FIG. 3, there is shown a large cup 30 having top threads 32 for mating with lid threads 34 in lid 38.

Cup 30 is sized to contain a handle 10 and an attached cartridge 16 and a solution of oil having a top surface 14. The cup bottom 35 is sized to permit the cartridge 16 to rest thereon. The larger cup could be used for traveling or storing several cartridges simultaneously.

One method of maintaining the sharpness of razor blade cartridges comprises the steps of:

1. Opening a commercially available package of razor blade cartridges, of the type sold at retail outlets to consumers, where the package contains at least two cartridges and where each cartridge is a multi-razor cartridge having at least two parallel and slightly spaced-apart razor edges;

2. Placing a first of the cartridges in a cup of oil so that the first cartridge is completely covered by the oil.

3. Placing a second cartridge in the cup of oil so that the second cartridge is completely covered by the oil and disposed on top of the first cartridge which remains submerged in the oil.

4. Removing the second cartridge and shaving with it and leaving the first cartridge in the oil.

5. Using the second cartridge to shave numerous times and then discarding the second cartridge.

6. After the second cartridge is discarded the first cartridge can be removed and used for shaving repeatedly.

This notion of storing cartridges in oil while other cartridges are being used is believed to enhance the total usable life of an entire package of cartridges because all of the cartridges become exposed to the air and humidity as soon as the package is opened. This exposure to the air can reduce the life of a razor cartridge even before it is ever used.

The process of using the same cartridge several times could involve merely re-entering the cartridge into the oil after the cartridge has been rinsed clean or the razor edges could be allowed to dry or dried with a drier and then placed in the oil for continued storage (such as overnight) and for treatment of the blades with the oil. When the cartridge is removed from the oil, it could be allowed to drain, or it could be used immediately and thereby providing oil for lubrication and conditioning of the face.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

What is claimed is:

1. A method of maintaining sharpness of razor blades comprising the steps of:

providing a package of a plurality of razor blade cartridges, where each razor blade cartridge comprises a plurality of stacked and shifted parallel razor blades held in place by a structure;

opening the package;

removing a plurality of razor blade cartridges from the package and before any of said plurality of razor blade cartridges are used, causing the plurality of razor blade cartridges to be disposed within a cup and being completely covered with an oil solution;

simultaneously storing the plurality of razor blade cartridges in the cup while the plurality of razor blade cartridges remain submerged in the oil solution;

removing a first razor blade cartridge of the plurality of razor blade cartridges in the cup and using it for shaving while another of the plurality of razor blade cartridges remains in the cup and remains completely covered by the oil solution; and shaving with the first razor blade cartridge, removing material from the first razor blade cartridge and returning the first razor blade cartridge to the cup where it is completely covered with the oil solution.

2. The method of claim 1 wherein the step of causing the plurality of razor blade cartridges to be disposed within a cup and being completely covered with an oil solution further comprises the steps of:

placing the plurality of razor blade cartridges into a cup having a predetermined amount of oil therein and causing the plurality of razor blade cartridges to become submerged in the oil solution.

3. The method of claim 1 wherein the oil solution is a mineral oil solution.

4. The method of claim 1 wherein the oil solution is baby oil.

5. The method of claim 3 wherein the oil solution comprises Vitamin E and aloe vera extract.

6. The method of claim 5 wherein the oil solution further comprises a fragrance.

7. The method of claim 3 wherein the mineral oil solution further comprises a germicidal agent.

8. The method of claim 3 wherein the mineral solution is a predetermined volume which is stored in the cup which is re-sealable.

9. The method of claim 8 wherein the cup is threaded to facilitate sealing a lid to the cup.

10. The method of claim 9 wherein the first razor blade cartridge is used repeatedly for shaving while no other razor blade cartridges in the plurality of razor blade cartridges is removed from the cup until the first razor blade cartridge is discarded.

11. The method of claim 2 wherein the step of placing the plurality of razor blade cartridges into a cup having a predetermined amount of oil solution therein, and causing the plurality of razor blade cartridges to become submerged in the oil solution, further comprises unscrewing a threaded cap of a cup having a predetermined amount of oil solution disposed therein and dropping the plurality of razor blade cartridges into the predetermined amount of oil solution.

12. The method of claim 11 wherein the predetermined amount of oil solution is an amount substantially equal to four fluid ounces and where the oil solution is a fragrance enhanced mineral oil solution.

13. The method of claim 11 wherein the cup is sized and configured to receive and retain therein a cartridge and a handle coupled to the cartridge.

14. The method of claim 13 wherein the cup is a blow-molded wide-mouth bottle.

15. The method of claim 11 further comprising the steps of repeatedly and exclusively shaving with the first razor blade cartridge until substantially 200 shaves have occurred.

16. A method for maintaining razor blade sharpness comprising:

providing a cup with a predetermined amount of mineral oil solution, the cup comprising a re-sealable cap;

the cup being sized to contain a plurality of razor blade cartridges;

storing said plurality of razor blade cartridges submerged in said mineral oil solution disposed in said cup, before any of said plurality of razor blade cartridges is used for shaving;

shaving with a first of the plurality of razor blade cartridges;

returning for storage the first of the plurality of razor blade cartridge submerged in the mineral oil solution;

repeatedly shaving with and storing in the mineral oil solution, the first of the plurality of razor blade cartridges until a predetermined number of shaves is reached;

discarding the first of the plurality of razor blade cartridges after the predetermined number of shaves is reached; and shaving with another of the plurality of razor blade cartridges.

17. The method of claim 16 wherein the predetermined number of shaves is substantially 200 shaves.

18. The method of claim 16 wherein the first of the plurality of razor blade cartridges is used exclusively of another of the plurality of razor blade cartridges until the first of the razor blade cartridges is discarded.

19. The method of claim 18 wherein the plurality of razor blade cartridges is all of razor blade cartridges in a retail consumer package of razor blade cartridges.

20. A method of extending the useful service life of a retail package of commercially available consumer razor blade cartridges comprising the steps of:

providing a retail package of a plurality of consumer razor blade cartridges;

providing sealed wide-mouthed container holding substantially four fluid ounces of a mineral oil solution;

unscrewing a cap from the container and depositing in the cup all of the plurality of razor blade cartridges from the package;

before any of said plurality of razor blade cartridges is used for shaving, storing all of the plurality of razor blade cartridges in the mineral oil solution;

the mineral oil solution further comprising Vitamin E, aloe vera extract, and a germicidal agent;

storing a handle configured to be coupled with each of the plurality of razor blade cartridges in the container;

shaving with the plurality of razor blade cartridges;

storing each of the plurality of razor blade cartridges in the mineral oil solution when not being used for shaving until being discarded; and screwing the cap on the container while the handle is disposed therein and transporting the container, the plurality of razor blade cartridges and the handle to a different location.

* * * * *